US007258617B2

(12) United States Patent
Chen

(10) Patent No.: US 7,258,617 B2
(45) Date of Patent: Aug. 21, 2007

(54) CHILD SWING WITH A CHILD SEAT REMOVABLE TO SERVE AS A CAR SEAT

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 87 days.

(21) Appl. No.: 11/232,958

(22) Filed: Sep. 23, 2005

(65) Prior Publication Data

US 2006/0276253 A1 Dec. 7, 2006

(30) Foreign Application Priority Data

Jun. 6, 2005 (CN) ..... 2005 2 0109124 U

(51) Int. Cl.
*A63G 9/02* (2006.01)

(52) U.S. Cl. ..... 472/118; 472/119; 297/130

(58) Field of Classification Search ..... 472/118–125; 297/130

See application file for complete search history.

(56) References Cited

U.S. PATENT DOCUMENTS

| | | | | |
|---|---|---|---|---|
| 5,562,548 | A | 10/1996 | Pinch et al. | |
| 6,331,032 | B1 | 12/2001 | Haut et al. | |
| 6,857,966 | B2 * | 2/2005 | Armbruster et al. | 472/118 |
| 6,887,161 | B2 * | 5/2005 | Mahlstedt et al. | 472/119 |
| 2003/0203761 | A1 | 10/2003 | Malhstedt et al. | |
| 2004/0198512 | A1 | 10/2004 | Ransil et al. | |
| 2006/0211506 | A1 * | 9/2006 | Kakuda | 472/118 |

* cited by examiner

*Primary Examiner*—Kien T. Nguyen
(74) *Attorney, Agent, or Firm*—Pillsbury Winthrop Shaw Pittman, LLP

(57) ABSTRACT

A child swing includes a foldable support stand, a child seat and a locking device. The support stand includes two front support legs, two rear support legs, and two first coupling housings interconnecting the front and rear support legs such that the rear support legs can pivot toward the front support legs. Two swing arms are connected respectively and pivotally to the first coupling housings. Two second coupling housings are connected respectively and fixedly to lower ends of the swing arms. Two U-shaped support rods are connected to the second coupling housings, and are pivotable toward each other. The locking device locks the child seat releaseably on the U-shaped support rods.

17 Claims, 7 Drawing Sheets

CHILD SWING WITH A CHILD SEAT REMOVABLE TO SERVE AS A CAR SEAT

CROSS-REFERENCE TO RELATED APPLICATION

This application claims priority of Chinese Application No. 200520109124.X, filed on Jun. 6, 2005.

BACKGROUND OF THE INVENTION

1. Field of the Invention

This invention relates to a child swing, and more particularly to a child swing that has a child seat, which can be removed from a child swing frame to serve as a car seat.

2. Description of the Related Art

Referring to FIG. 1, a convertible child swing 1 disclosed in U.S. Pat. No. 5,562,548 is shown to include a support stand 11, a swing frame 12, a base 13 coupled to the swing frame 12, and a child seat 14 that can also function as a car seat. The swing frame 12 is connected pivotally to the support stand 11. The child seat 14 is disposed removably on the base 13. The base 13 includes two latch assemblies 131, each of which has a latch arm 132. The latch arms 132 are inserted respectively into slots (not shown) in the child seat 14 so as to retain the child seat 14 on the base 13. The latch assemblies 131 can be pivoted outwardly to disengage the latch arms 132 from the slots in the child seat 14 so as to allow for removal of the child seat 14 from the base 13. Although the child seat 14 can be removed for use as the car seat, the child swing 1 is not foldable and therefore is inconvenient to transport and store. Furthermore, because the latch assemblies 131 are disposed on the base 13, it is difficult to connect/disconnect the child seat 14 to/from the base 13.

Referring to FIGS. 2 and 3, a child swing 2 disclosed in U.S. Patent Application Publication No. 2004/0198512 is shown to include a support frame 21, a hanger arm 22 connected pivotally to the support frame 21, and a seat 23. The support frame 21 includes two housings 211, two front legs 212 connected respectively and fixedly to the housings 211, and two rear support legs 213. The seat 23 has a seat bottom 231 and a seat back 232. When it is desired to fold the child swing 2, the rear support legs 213 and the seat back 232 are pivoted respectively toward the front legs 212 and the seat bottom 231, as shown in FIG. 4. Although the child swing 2 is foldable, the seat 23 cannot function as a car seat.

SUMMARY OF THE INVENTION

An object of this invention is to provide a child swing that includes a child seat, which can be removed from a child swing frame to serve as a car seat.

Another object of this invention is to provide a child swing that includes a support stand and a child seat, which can be easily interconnected and separated.

According to this invention, a child swing includes a foldable support stand, a child seat and a locking device. The support stand includes two front support legs, two rear support legs, and two first coupling housings interconnecting the front and rear support legs such that the rear support legs can pivot toward the front support legs. Two swing arms are connected respectively and pivotally to the first coupling housings. Two second coupling housings are connected respectively and fixedly to lower ends of the swing arms. Two U-shaped support rods are connected to the second coupling housings, and are pivotable toward each other. The locking device locks the child seat releaseably on the U-shaped support rods.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
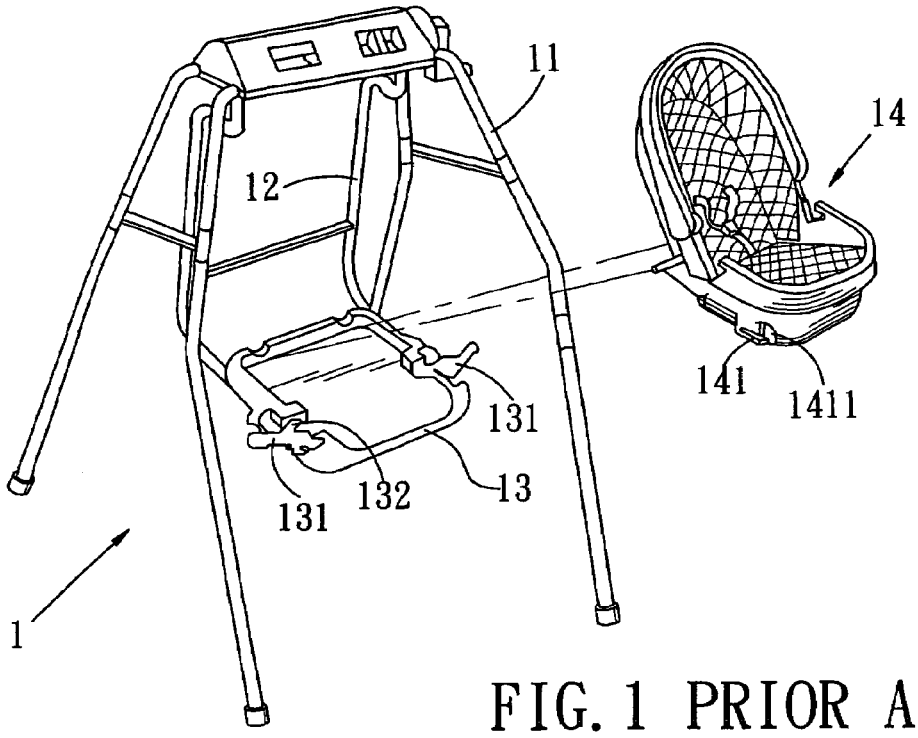
FIG. 1 PRIOR ART
FIG. 1 is a perspective view of a convertible child swing disclosed in U.S. Pat. No. 5,562,548.
Figure 2:
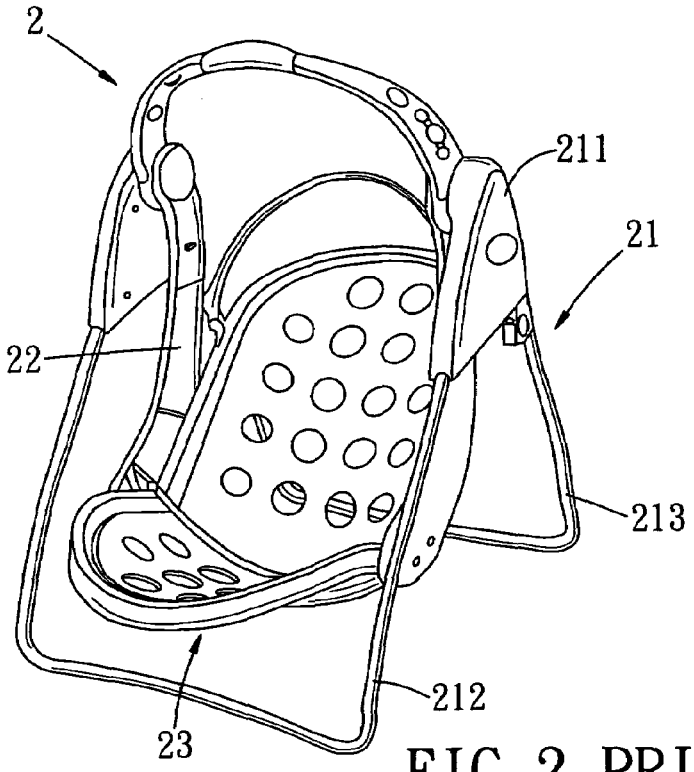
FIG. 2 PRIOR ART
FIG. 2 is a perspective view of a child swing disclosed in U.S. Patent Publication No. 2004/0198512.
Figure 3:
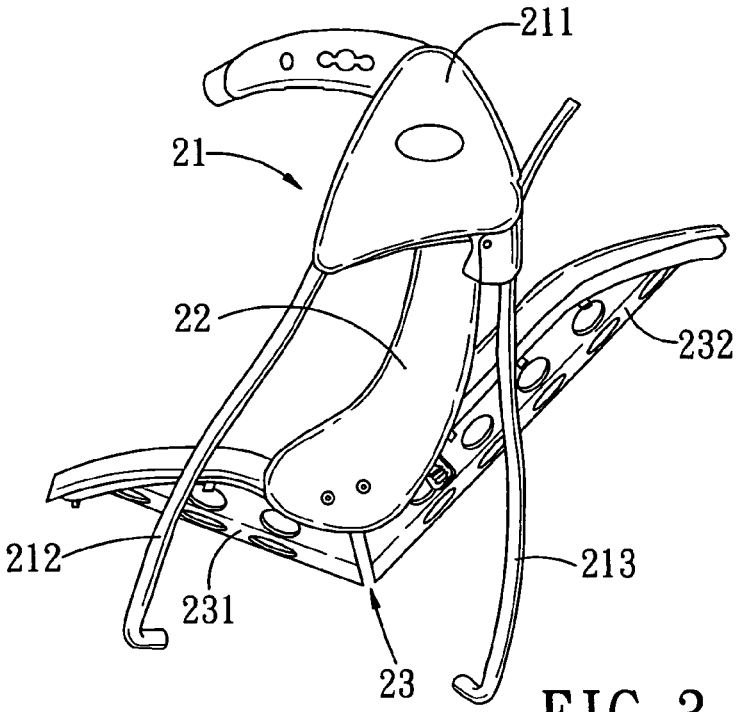
FIG. 3 PRIOR ART
FIG. 3 is a side view of the child swing shown in FIG. 2 when in an unfolded state.
Figure 4:
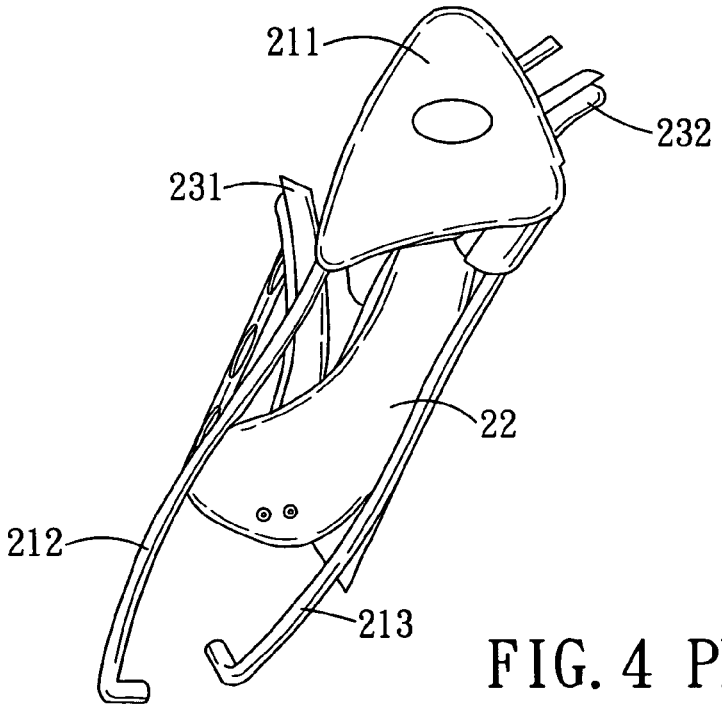
FIG. 4 PRIOR ART
FIG. 4 is a side view of the child swing shown in FIG. 3 when in a folded state.
Figure 5:
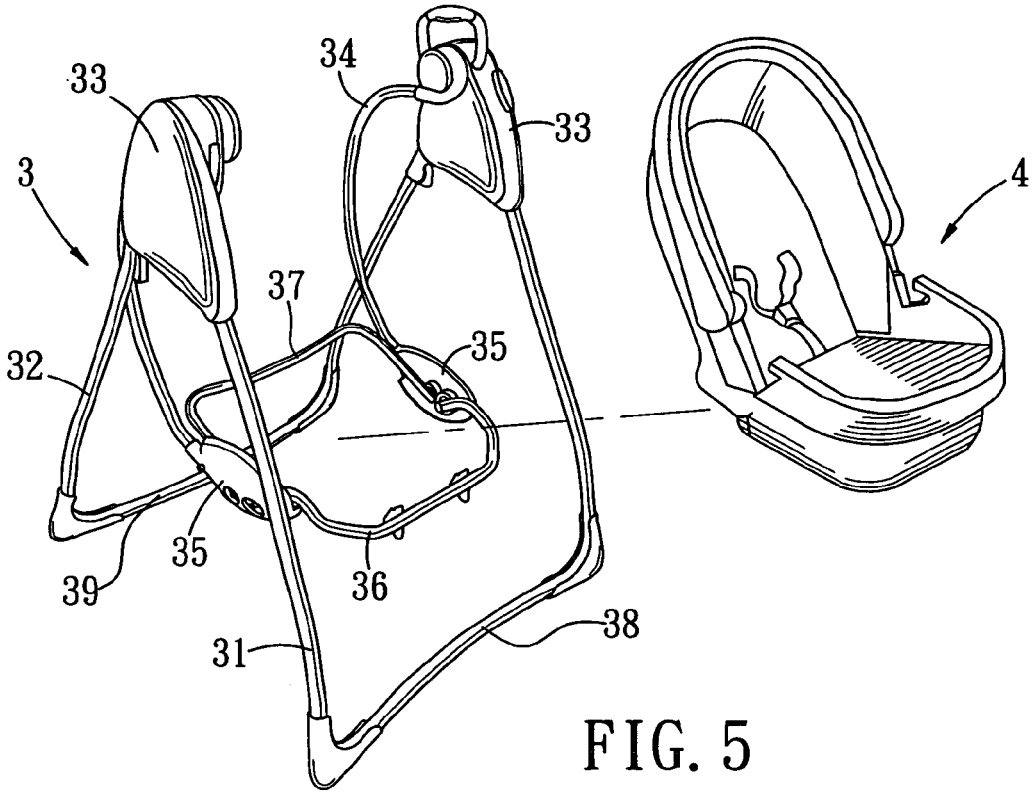
FIG. 5 is a perspective view of the first preferred embodiment of a child swing according to this invention.
Figure 6:
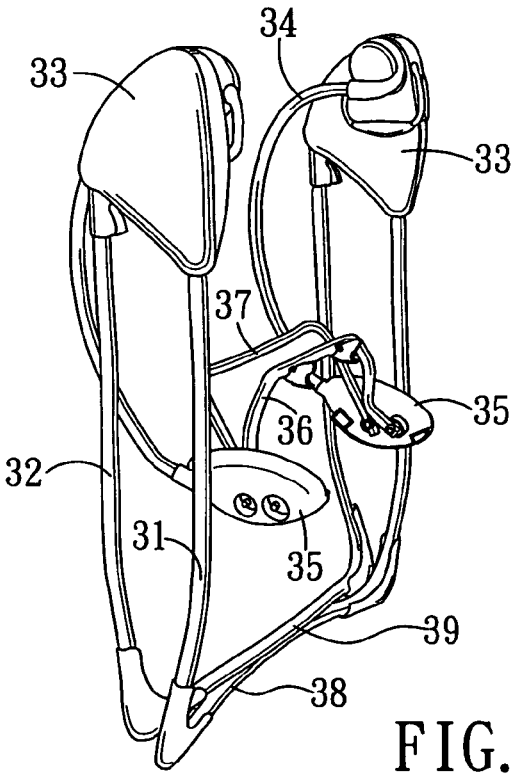
FIG. 6 is a perspective view of a support stand of the first preferred embodiment when it is in a folded state.
Figure 11:
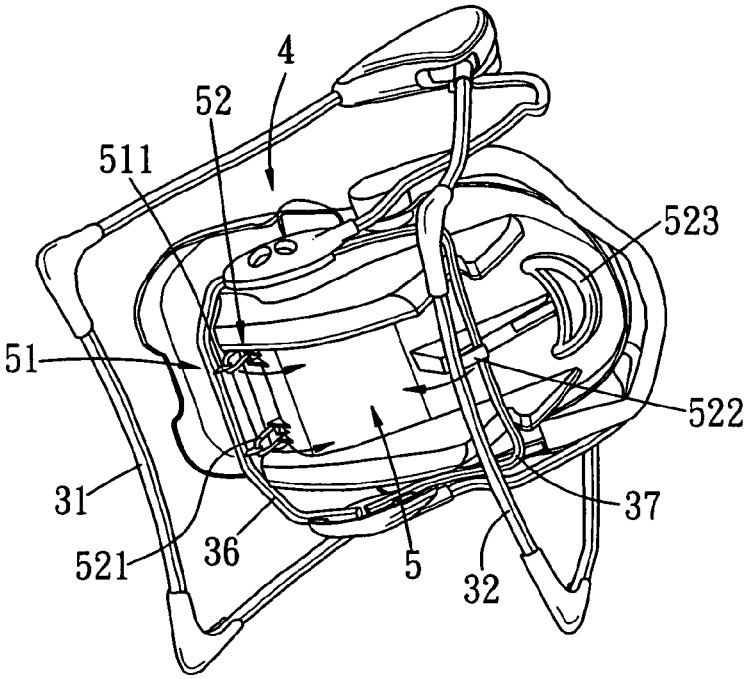
FIG. 11 is a perspective view of the first preferred embodiment, illustrating the locking device.

Referring to FIGS. 5 and 6, the first preferred embodiment of a child swing according to this invention includes a support stand 3, a child seat 4 and a locking device 5 (see FIG. 11).

The support stand 3 includes a pair of spaced-apart front support legs 31, a pair of spaced-apart rear support legs 32 disposed behind the front support legs 31, a pair of first coupling housings 33, a pair of swing arms 34, a pair of second coupling housings 35, a pair of front and rear U-shaped support rods 36, 37, and a pair of front and rear connecting rods 38, 39. The front support legs 31 are interconnected fixedly by the front connecting rod 38. The rear support legs 32 are interconnected fixedly by the rear connecting rod 39. Each of the first coupling housings 33 interconnects upper ends of the corresponding front support leg 31 and the corresponding rear support leg 32 such that the rear support legs 32 can pivot toward the front support legs 31.

Figure 7:
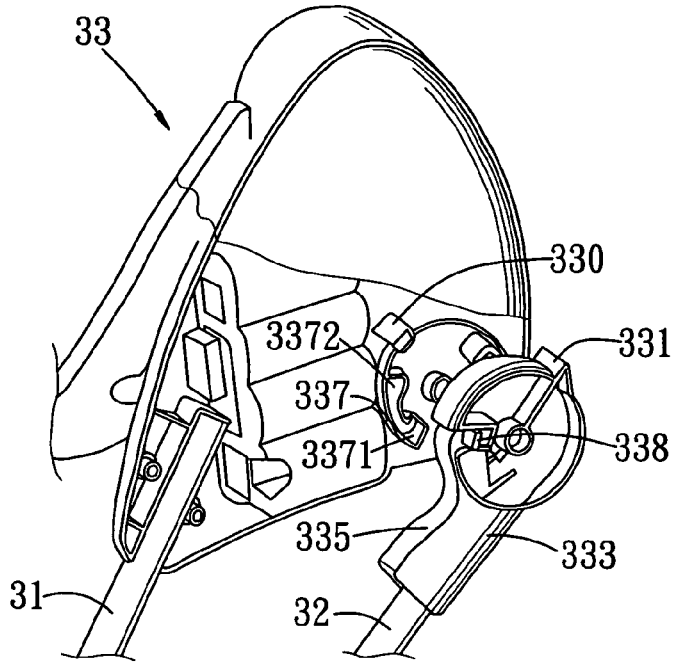
FIG. 7 is a fragmentary, partly exploded perspective view of the first preferred embodiment, illustrating how a first coupling housing is connected to a front support leg and a rear support leg.
Figure 8:
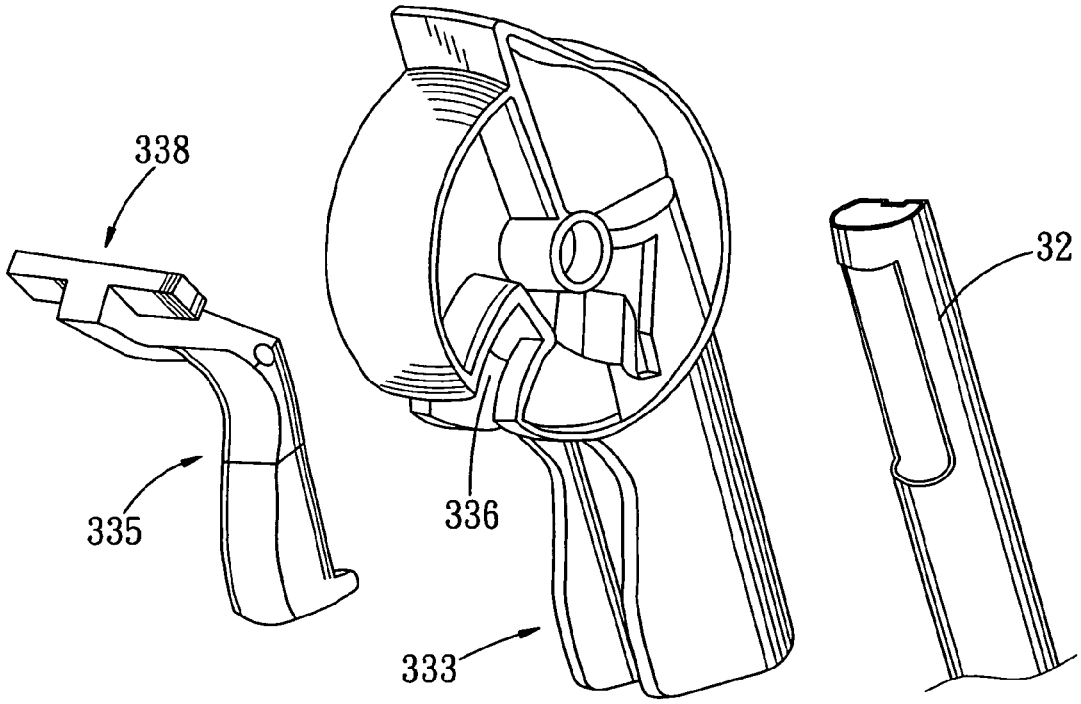
FIG. 8 is an exploded perspective view of the rear support leg, a sleeve member and a release lever of the first preferred embodiment.

With further reference to FIGS. 7 and 8, each of the first coupling housings 33 includes a fixed stop member 330. The front support legs 31 are connected respectively and fixedly to the first coupling housings 33. Two sleeve members 333 are sleeved respectively and fixedly on upper ends of the rear support legs 32, and are connected respectively and rotatably to the first coupling housings 33. Each sleeve member 333 is formed with a fixed angle-limiting member 331 abutting against the stop member 330 of the corresponding first coupling housing 33. This prevents pivoting of the corresponding rear support leg 32 from a normal position shown in FIG. 5 in a direction away from the corresponding front support leg 31. Each of the first coupling housings 33 further includes a slide slot 337 having a first slot portion 3371 and a second slot portion 3372, and an operating member or release lever 335 disposed pivotally on the corresponding sleeve member 333 and having an integral locking pin 338 disposed within the first slot portion 3371 of the slide slot 337 so as to prevent pivoting of the corresponding rear support leg 32 toward the corresponding front support leg 31. The release levers 335 are operable to move the locking pins 338 into the second slot portions 3372 so as to allow for pivoting of the rear support legs 32 toward the front support legs 31. As a consequence, the rear support legs 32 can be pivoted to abut against the front support legs 31, as shown in FIG. 6. Because the structure illustrated in FIGS. 7 and 8 has been disclosed in U.S. patent application Publication No. 2004/0198512 as a rear leg fold mechanism, a further description thereof will be omitted herein. Alternatively, the front and rear support legs 31, 32 may be replaced with any other suitable front and rear support legs that are pivotable and foldable relative to each other.

The swing arms 34 are connected respectively and pivotally to the first coupling housings 33, and are swingable forwardly and rearwardly. The second coupling housings 35 are connected respectively and fixedly to lower ends of the swing arms 34.

Figure 9:
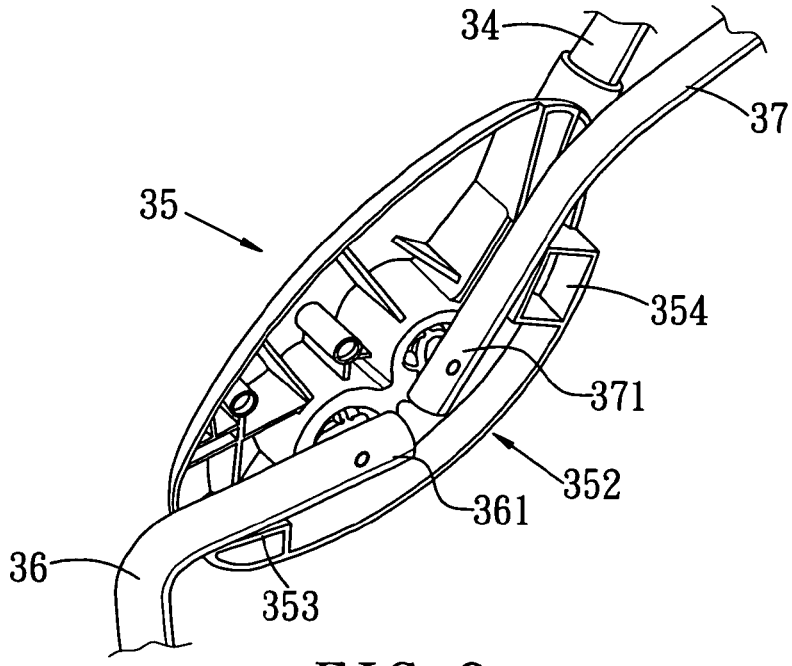
FIG. 9 is a perspective view illustrating a second coupling housing and two U-shaped support rods of the first preferred embodiment.

With additional reference to FIG. 9, each of the second coupling housings 35 includes a supporting seat 352 and a pair of front and rear stop blocks 353, 354 connected respectively and fixedly to front and rear ends of the second coupling housing 35. Each of the front and rear U-shaped support rods 36, 37 has two ends 361, 371 connected respectively and pivotally to the second coupling housings 35. Each end 361, 371 of the front and rear U-shaped support rods 36, 37 is connected pivotally to the corresponding second coupling housing 35 at a position between the front and rear stop blocks 353, 354 of the corresponding second coupling housing 35. The front U-shaped support rod 36 abuts against and is disposed above the front stop blocks 353. The rear U-shaped support rod 37 abuts against and is disposed above the rear stop blocks 354. This limits a maximum angle between the front and rear U-shaped support rods 36, 37, while allowing for pivoting of the front and rear U-shaped support rods 36, 37 toward each other when the support stand 3 is folded, as shown in FIG. 6.

Figure 9A:
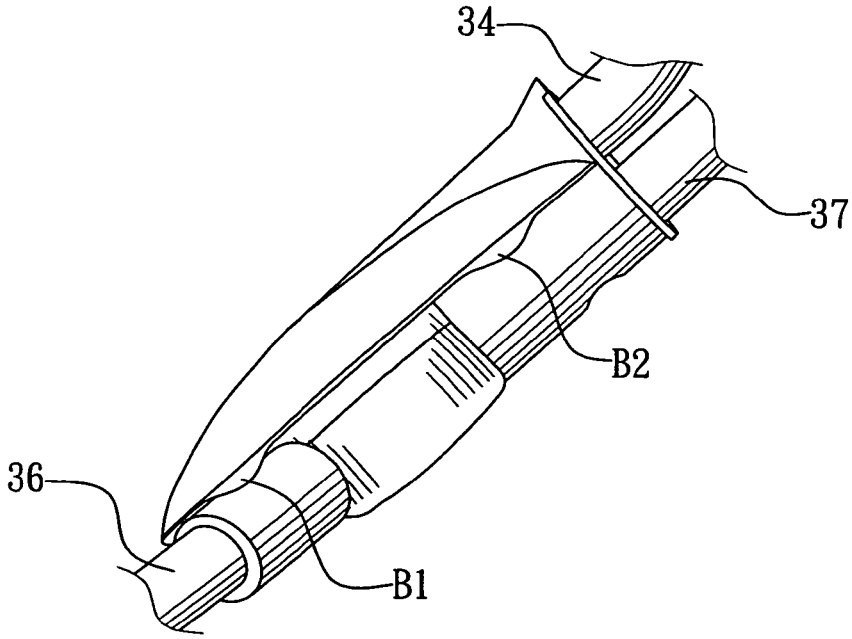
FIG. 9A is a fragmentary perspective view of a modified second coupling housing and the two U-shaped support rods of the preferred embodiment when the two U-shaped support rods are in an unfolded state.
Figure 9B:
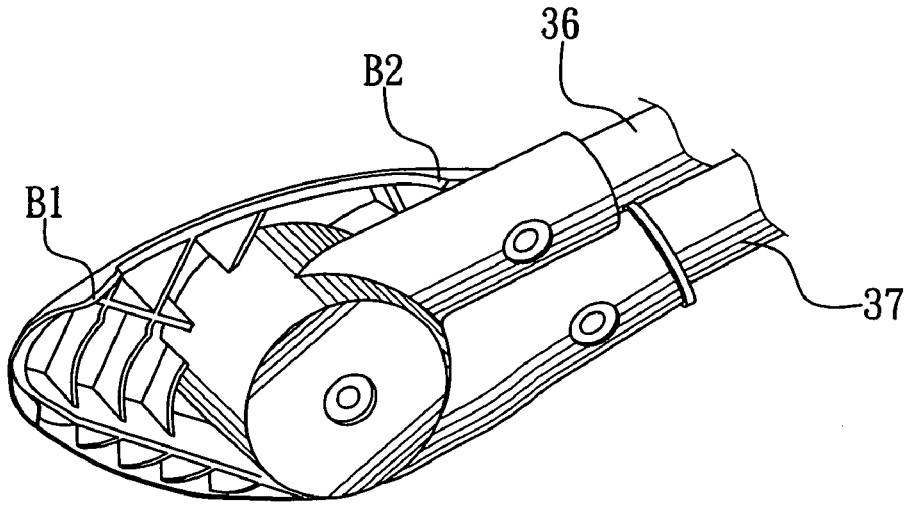
FIG. 9B is a fragmentary perspective view of the modified second coupling housing and the two U-shaped support rods of the preferred embodiment when the two U-shaped support rods are in a folded state.

With additional reference to FIGS. 9A and 9B, each of the second coupling housings 35 further includes a first boss (B1) in frictional contact with the corresponding front U-shaped support rod 36 so as to prevent rearward pivoting movement of the front U-shaped support rod 36 relative to the corresponding second coupling housing 35 when the corresponding front U-shaped support rod 36 abuts against the corresponding front stop block 353, and a second boss (B2) disposed in proximity to the corresponding rear U-shaped support rod 37 when the corresponding rear U-shaped support rod 37 abuts against the corresponding rear stop block 354. The front U-shaped support rod 36 can be pivoted forcibly to separate from the first boss (B1) so as to abut against the rear U-shaped support rod 37. As shown in FIG. 9B, when the front U-shaped support rod 37 abuts against the rear U-shaped support rod 37, it comes into frictional with the second boss (B2). This prevents forward pivoting movement of the front U-shaped support rod 36 relative to the corresponding second coupling housing 35.

Figure 10:
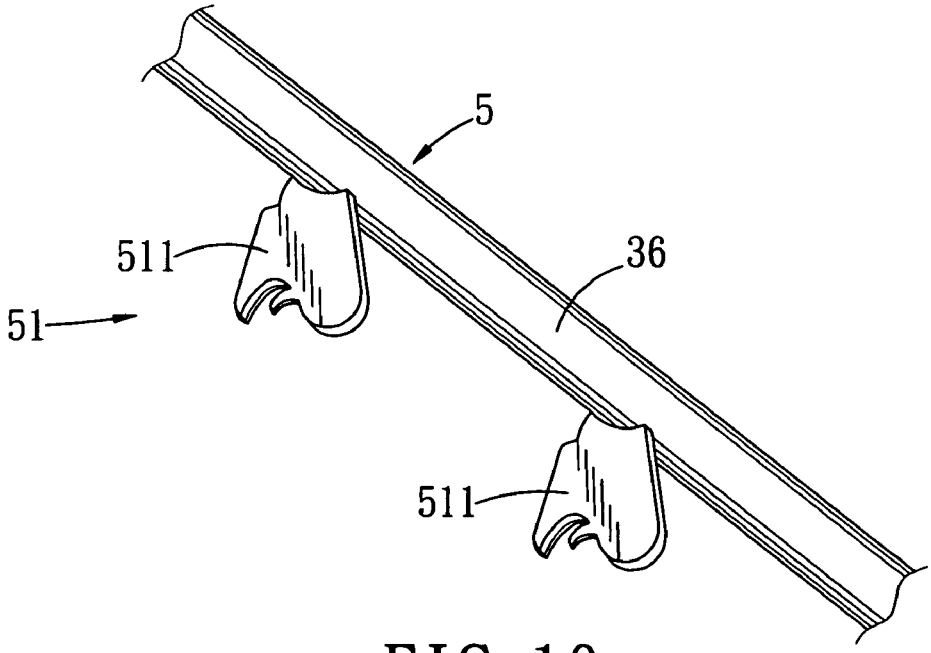
FIG. 10 is a perspective view of a first retaining member of a locking device of the preferred embodiment.

Referring to FIGS. 10 and 11, the locking device 5 includes a first retaining member 51, a second retaining member 52, a catch member 522 and an actuator 523. The first retaining member 51 includes two spaced-apart hooks 511 welded on the front U-shaped support rod 36. The second retaining member 52 includes two retaining rings 521 disposed movably on the child seat 4 and engaging respectively the hooks 511 so as to retain the child seat 4 on the front U-shaped support rod 36. The catch member 522 is disposed movably on the child seat 4, and engages the rear U-shaped support rod 37 so as to retain the child seat 4 on the rear U-shaped support rod 37. The support rod 37 may be formed with a positioning element (not shown), which engages the catch member 522 so as to prevent movement of the catch member 522 on the support rod 37. As such, the child seat 4 is locked releaseably on the front and rear U-shaped support rods 36, 37 by the locking device 5. The actuator 523 is disposed on the child seat 4, and is connected operatively to the retaining rings 511 and the catch member 522. When it is desired to remove the child seat 4 from the support stand 3, the actuator 523 is operated to release the retaining rings 521 and the catch member 522 from the front and rear U-shaped support rods 36, 37, respectively. The operation of the actuator 523 is disclosed in U.S. Pat. No. 6,331,032. Alternatively, the actuator 523 may be replaced with any other suitable actuator operable to allow for locking and unlocking of the child seat 4.

Figure 12:
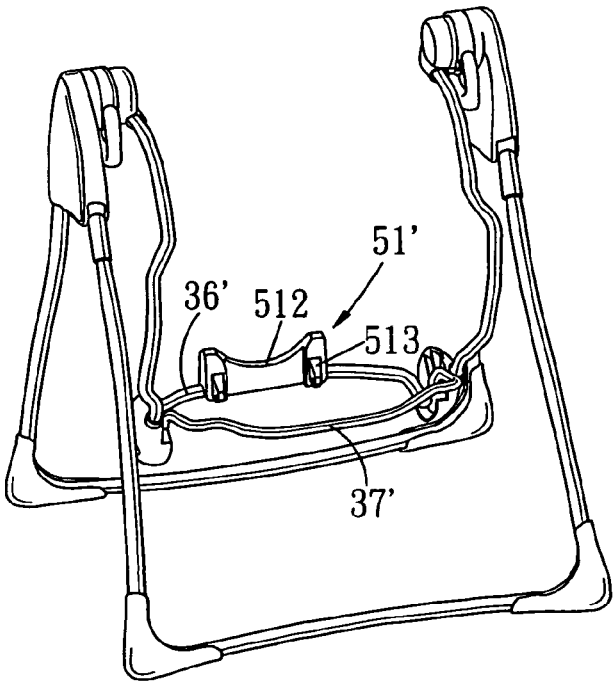
FIG. 12 is a perspective view of the second preferred embodiment, illustrating a modified first retaining member.

FIG. 12 shows a modified first retaining member 51' that includes a mounting seat 512 molded on and, thus, sleeved fixedly around the front U-shaped support rod 36', and two spaced-apart hooks 513 formed integrally with the mounting seat 512. As such, the manufacturing process of the first retaining member 51' is simplified.

With this invention thus explained, it is apparent that numerous modifications and variations can be made without departing from the scope and spirit of this invention. It is therefore intended that this invention be limited only as indicated by the appended claims.

I claim:

1. A child swing comprising:

a foldable support stand including a pair of spaced-apart front support legs, a pair of spaced-apart rear support legs disposed behind said front support legs, a pair of first coupling housings, each of which interconnects a corresponding one of said front support legs and a corresponding one of said rear support legs such that the corresponding one of said front support legs and the corresponding one of said rear support legs can pivot toward each other, a pair of swing arms connected respectively and pivotally to said first coupling housings and swingable forwardly and rearwardly, a pair of second coupling housings connected respectively and fixedly to lower ends of said swing arms, and a pair of front and rear U-shaped support rods each having two ends attached respectively to said second coupling housings such that said front and rear U-shaped support rods can pivot toward each other;

a child seat; and a locking device for locking said child seat releaseably on said front and rear U-shaped support rods;

wherein each of said second coupling housings includes a pair of front and rear stop blocks connected respectively to front and rear ends thereof, a first boss disposed in proximity to said front U-shaped support rod so as to prevent rear pivoting movement of said front U-shaped support rod relative to a corresponding one of said second coupling housings when said front U-shaped support rod abuts against said front stop block, and a second boss disposed in proximity to said rear U-shaped support rod so as to prevent forward pivoting movement of said front U-shaped support rod relative to the corresponding one of said second coupling housings when said rear U-shaped support rod abuts against said rear stop block and when said front U-shaped support rod abuts against said rear U-shaped support rod.

2. The child swing as claimed in claim 1, wherein said support stand further includes a front connecting rod interconnecting fixedly lower ends of said front support legs, and a rear connecting rod interconnecting fixedly lower ends of said rear support legs, each of said front and rear support legs having an upper end connected to a corresponding one of said first coupling housings such that said front and second connecting rods are pivotable toward each other to thereby abut against each other.

3. The child swing as claimed in claim 1, wherein each of said rear support legs is provided with an operating member operable to allow for pivoting of a corresponding one of said rear support legs toward a corresponding one of said front support legs.

4. The child swing as claimed in claim 3, wherein each of said first coupling housings includes a fixed stop member, said front support legs being connected respectively and fixedly to said first coupling housings, said rear support legs being connected respectively and rotatably to said first coupling housings, each of said rear support legs being formed with a fixed angle-limiting member abutting against said stop member of a corresponding one of said first coupling housings so as to prevent pivoting of a corresponding one of said rear support legs away from a corresponding one of said front support legs, each of said first coupling housings further including a slide slot having a first slot portion and a second slot portion, and a release lever disposed pivotally on the corresponding one of said rear support legs and having an integral locking pin disposed within said first slot portion of said slide slot so as to prevent pivoting of the corresponding one of said rear support legs toward the corresponding one of said front support legs, said release levers constituting said operating members and being operable to move said locking pins of said release levers into said second slot portions so as to allow for pivoting of said rear support legs toward said front support legs.

5. The child swing as claimed in claim 1, wherein said ends of each of said front and rear U-shaped support rods are connected respectively and pivotally to said second coupling housings, each of said second coupling housings including a supporting seat, each of said ends of said front and rear U-shaped support rods being connected pivotally to a corresponding one of said second coupling housings at a position between said front and rear stop blocks of the corresponding one of said second coupling housings, said front U-shaped support rod abutting against and being disposed above said front stop blocks and said rear U-shaped support rod abutting against and being disposed above said rear stop blocks so as to limit a maximum angle between said front and rear U-shaped support rods and so as to allow for pivoting of said front and rear U-shaped support rods toward each other.

6. The child swing as claimed in claim 5, wherein said locking device includes a first retaining member disposed on said front U-shaped support rod, and a second retaining member disposed on said child seat and connected removably to said first retaining member so as to retain said child seat on said front U-shaped support rod.

7. The child swing as claimed in claim 6, wherein said first retaining member includes two spaced-apart hooks fixed on said front U-shaped support rod, said second retaining member including two retaining rings that are disposed movably on said child seat and that engage respectively said hooks.

8. The child swing as claimed in claim 6, wherein said locking device further includes a catch member disposed movably on said child seat and engaging said rear U-shaped support rod so as to retain said child seat on said rear U-shaped support rod.

9. The child swing as claimed in claim 8, wherein said locking device further includes an actuator disposed on said child seat and connected operatively to said retaining rings and said catch member, said actuator being operable to release said retaining rings and said catch member from said front and rear U-shaped support rods.

10. The child swing as claimed in claim 9, wherein said first retaining member includes a mounting seat molded on and sleeved fixedly on said front U-shaped support rod, and two spaced-apart hooks formed integrally with said mounting seat, said second retaining member including two retaining rings disposed movably on said child seat and engaging respectively said hooks so as to retain said child seat on said front U-shaped support rod.

11. The child swing as claimed in claim 1, wherein said locking device includes a first retaining member disposed on said front U-shaped support rod, and a second retaining member disposed on said seat frame of said child seat and connected removably to said first retaining member so as to retain said child seat on said front U-shaped support rod.

12. A foldable support stand for a child swing, the child swing including a child seat, said support stand being adapted to be connected removably to the child seat and comprising:

a pair of spaced-apart front support legs;

a pair of spaced-apart rear support legs disposed behind said front support legs;

a pair of first coupling housings, each of which interconnects a corresponding one of said front support legs and a corresponding one of said rear support legs such that the corresponding one of said front support legs and the corresponding one of said rear support legs can pivot toward each other;

a pair of swing arms connected respectively and pivotally to said first coupling housings and swingable forwardly and rearwardly;

a pair of second coupling housings connected respectively and fixedly to lower ends of said swing arms; and a pair of front and rear U-shaped support rods each having two ends attached respectively to said second coupling housings such that said front and rear U-shaped support rods can pivot toward each other;

wherein each of said second coupling housings includes a pair of front and rear stop blocks connected respectively to front and rear ends thereof, a first boss disposed in proximity to said front U-shaped support rod so as to prevent rear pivoting movement of said front U-shaped support rod relative to a corresponding one of said second coupling housings when said front U-shaped support rod abuts against said front stop block, and a second boss disposed in proximity to said rear U-shaped support rod so as to prevent forward pivoting movement of said front U-shaped support rod relative to the corresponding one of said second coupling housings when said rear U-shaped support rod abuts against said rear stop block and when said front U-shaped support rod abuts against said rear U-shaped support rod.

13. The foldable support stand as claimed in claim 12, wherein said support stand further includes a front connecting rod interconnecting fixedly lower ends of said front support legs, and a rear connecting rod interconnecting fixedly lower ends of said rear support legs, each of said front and rear support legs having an upper end connected to a corresponding one of said first coupling housings such that said front and second connecting rods are pivotable toward each other to thereby abut against each other.

14. The foldable support stand as claimed in claim 12, wherein each of said rear support legs is provided with an operating member operable to allow for pivoting of a corresponding one of said rear support legs toward a corresponding one of said front support legs.

15. The foldable support stand as claimed in claim 14, wherein each of said first coupling housings includes a fixed stop member, said front support legs being connected respectively and fixedly to said first coupling housings, said rear support legs being connected respectively and rotatably to said first coupling housings, each of said rear support legs being formed with a fixed angle-limiting member abutting against said stop member of a corresponding one of said first coupling housings so as to prevent pivoting of a corresponding one of said rear support legs away from a corresponding one of said front support legs, each of said first coupling housings further including a slide slot having a first slot portion and a second slot portion, and a release lever disposed pivotally on the corresponding one of said rear support legs and having an integral locking pin disposed within said first slot portion of said slide slot so as to prevent pivoting of the corresponding one of said rear support legs toward the corresponding one of said front support legs, said release levers constituting said operating members and being operable to move said locking pins of said release levers into said second slot portions so as to allow for pivoting of said rear support legs toward said front support legs.

16. The foldable support stand as claimed in claim 12, wherein said ends of each of said front and rear U-shaped support rods are connected respectively and pivotally to said second coupling housings, each of said second coupling housings including a supporting seat, each of said ends of said front and rear U-shaped support rods being connected pivotally to a corresponding one of said second coupling housings at a position between said front and rear stop blocks of the corresponding one of said second coupling housings, said front U-shaped support rod abutting against and being disposed above said front stop blocks and said rear U-shaped support rod abutting against and being disposed above said rear stop blocks so as to limit a maximum angle between said front and rear U-shaped support rods and so as to allow for pivoting of said front and rear U-shaped support rods toward each other.

17. A child swing comprising:

a foldable support stand including a pair of spaced-apart front support legs, a pair of spaced-apart rear support legs disposed behind said front support legs, a pair of first coupling housings, each of which interconnects a corresponding one of said front support legs and a corresponding one of said rear support legs such that the corresponding one of said front support legs and the corresponding one of said rear support legs can pivot toward each other, a pair of swing arms connected respectively and pivotally to said first coupling housings and swingable forwardly and rearwardly, a pair of second coupling housings connected respectively and fixedly to lower ends of said swing arms, and a pair of front and rear U-shaped support rods each having two ends attached respectively to said second coupling housings such that said front and rear U-shaped support rods can pivot toward each other;

a child seat; and a locking device for locking said child seat releaseably on said front and rear U-shaped support rods;

wherein said locking device includes a mounting seat fixed on said front U-shaped support rod, and two spaced-apart hooks formed integrally with said mounting seat, said child seat including two retaining rings engaging respectively said hooks so as to retain said child seat on said front U-shaped support rod.

* * * * *